US009400008B2

(12) United States Patent
Tuttle

(10) Patent No.: US 9,400,008 B2
(45) Date of Patent: Jul. 26, 2016

(54) EASILY UNRAVELED TEXTILE ARTICLE

(71) Applicant: John L. Tuttle, Charlottesville, VA (US)

(72) Inventor: John L. Tuttle, Charlottesville, VA (US)

( * ) Notice: Subject to any disclaimer, the term of this patent is extended or adjusted under 35 U.S.C. 154(b) by 359 days.

(21) Appl. No.: 14/052,737

(22) Filed: Oct. 12, 2013

(65) Prior Publication Data

US 2014/0101903 A1 Apr. 17, 2014

Related U.S. Application Data

(60) Provisional application No. 61/712,808, filed on Oct. 12, 2012.

(51) Int. Cl.

| | |
|---|---|
| ***D04B 3/04*** | (2006.01) |
| ***F16B 45/02*** | (2006.01) |
| ***A41D 15/04*** | (2006.01) |
| ***A44C 5/00*** | (2006.01) |
| ***D04B 19/00*** | (2006.01) |

(52) U.S. Cl.

CPC ..... *F16B 45/02* (2013.01); *A41D 15/04* (2013.01); *A44C 5/0007* (2013.01); *D04B 3/04* (2013.01); *D04B 19/00* (2013.01); *Y10T 24/45319* (2015.01)

(58) Field of Classification Search

CPC ..... D04B 3/00; A41D 15/04; A42B 1/006; A41F 4/00; A41F 9/00; A44C 5/0007

USPC ..... 66/1 A

See application file for complete search history.

(56) References Cited

U.S. PATENT DOCUMENTS

| | | | | | |
|---|---|---|---|---|---|
| 3,438,223 | A * | 4/1969 | Linstead | D04B 3/00 | 66/1 A |
| 4,630,454 | A * | 12/1986 | Seremjian | D04B 33/00 | 66/1 A |
| 4,956,646 | A * | 9/1990 | Miller | H01Q 1/30 | 343/706 |
| 5,366,293 | A * | 11/1994 | Lii | A45C 9/00 | 383/117 |
| 5,379,613 | A | 1/1995 | Suzuki | | |
| 2007/0097688 | A1* | 5/2007 | Gibbons | A44C 5/0053 | 362/282 |
| 2011/0203533 | A1* | 8/2011 | Hurwitz | A01K 27/004 | 119/794 |
| 2011/0252649 | A1 | 10/2011 | Lovitz | | |
| 2013/0031935 | A1* | 2/2013 | Kelleghan | A44C 5/00 | 63/1.12 |
| 2013/0213089 | A1 | 8/2013 | Gagne | | |

OTHER PUBLICATIONS

Erich, Tactical Intelligence "Homemade Paracord Belt," retrieved from <http://www.tacticalintelligence.net/blog/homemade-paracord-belt.htm> on Sep. 12, 2013, 2 pages.

Erich, Tactical Intelligence "Slatt's Rescue Belt: Part 2," retrieved from <http://www.tacticalintelligence.net/blog/slatts-rescue-belt-part-2.htm> on Sep. 12, 2013, 3 pages.

* cited by examiner

*Primary Examiner* — Jenna Johnson

(74) *Attorney, Agent, or Firm* — Fish & Richardson P.C.

(57) ABSTRACT

A device is provided including a textile article. The textile article includes a leading edge comprising an open loop and a secured loose end. The device further includes a piece of hardware threaded through the open loop. The textile article is configured to easily unravel by removing the piece of hardware from the open loop and pulling upon the secured loose end.

18 Claims, 10 Drawing Sheets

EASILY UNRAVELED TEXTILE ARTICLE

CROSS REFERENCE TO RELATED APPLICATIONS

This disclosure claims the benefit of U.S. Provisional Application No. 61/712,808 filed on Oct. 12, 2012 which is hereby incorporated by reference.

TECHNICAL FIELD

This disclosure is related to a textile article that can be easily unraveled by the user. In one embodiment, the disclosure is related to a strap created with a cord, wherein the strap can be easily unraveled for occasions when use of the cord is desired.

BACKGROUND

The statements in this section merely provide background information related to the present disclosure. Accordingly, such statements are not intended to constitute an admission of prior art.

Textile articles can be created with yarn, string, cord, rope, and other similar materials. A number of textile processes are known in the art to create textile articles, including but not limited to knitting and crocheting. Such processes can be accomplished manually or through automated devices known in the art. Many textile techniques include creating a starting edge or bottom edge of the article and progressing away from the starting edge of the article. In knitting, the process of initiating the starting edge is known as casting on. In crocheting, one exemplary method to start a row is to create a chain stitch. Either knitting or crocheting can include attaching the starting edge to a loop, a buckle, a wire, or any other structure that the cord can be wrapped around. The textile article often includes a plurality of rows, one built off of the next. In knitting, a row or wale of stitches includes a series of open loops. In crocheting, a row of stitches includes a series of loops interconnected, with a last loop or open loop progressing along the row as the row is stitched. In knitting and crocheting, the row currently being stitched can be described as the leading edge or top edge. In knitting, crocheting, and similar textile techniques, one can unravel the article by simply pulling on the end of the cord or string when the article is in process.

Straps are an example of textile articles used in a wide variety of applications. Straps can be used to attach one item to another. Straps can be used to provide a shoulder harness for an item such as a handbag, a backpack, a firearm, or a guitar. Straps can be used to provide a quick connect device such as a carabiner or a key ring with a flexible second connection to another items such as a belt loop.

Straps are made from a wide variety of materials. Leather straps constructed of flat bands of material can be used. Cloth straps can be made of fabrics. Textile straps can be made of cords, rope, yarn, or other relatively large strands of material. Popular processes for creating a textile strap include knitting and crocheting.

The leading edge, on the other end, in an unfinished textile article, is easily unraveled. A loose end exists upon the leading edge of a textile article, and known knit or crochet patterns easily unravel by pulling on the loose end. Finishing the textile article includes capturing the open loop or loops. In knitting, finishing the article is known as casting off the article. In crocheting, finishing the article includes tying off the loose end through the last open loop. Finishing a textile article captures all previously open loops and ties off the loose end, such that the article is stable and not easily unraveled.

SUMMARY

A device is provided including a textile article. The textile article includes a leading edge comprising an open loop and a secured loose end. The device further includes a piece of hardware threaded through the open loop. The textile article is configured to easily unravel by removing the piece of hardware from the open loop and pulling upon the secured loose end.

BRIEF DESCRIPTION OF THE DRAWINGS

One or more embodiments will now be described, by way of example, with reference to the accompanying drawings, in which.

DETAILED DESCRIPTION

Figure 1:
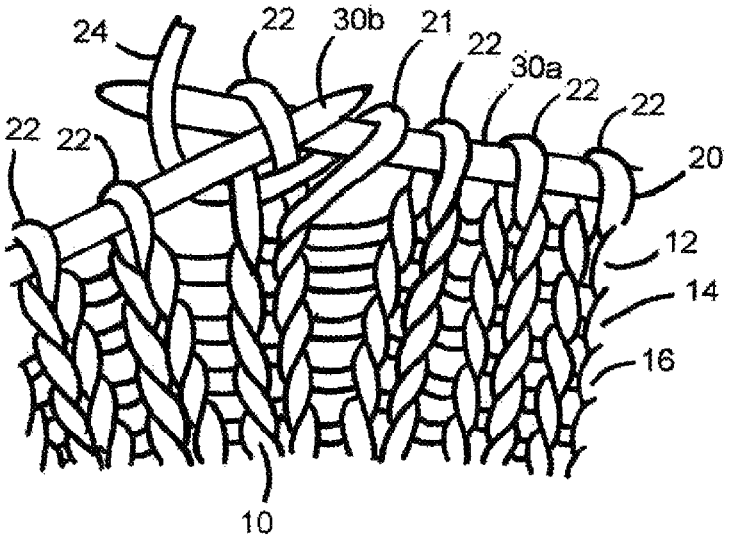
FIG.1 PRIOR ART
FIG. 1 illustrates an exemplary knitted article, in accordance with the present disclosure.

Textile articles made through knitting, crocheting, or other similar processes wherein pulling upon a loose end of an "unfinished" version of the article unravels the article can provide a user with a ready source of cord, rope, or whatever material with which the article is stitched. Similarly, a textile article can be constructed such that the unraveling of the unfinished article is a marketable event for the item.

Throughout the disclosure, processes will describe knitting and crocheting. It should be appreciated that such processes are well known in the art. Such processes include a number of stitches, techniques, shapes, patterns, color transitions, and other enhancements known in the art. Any such processes can be used with the textiles disclosed herein so long as pulling on the loose end will unravel all or a portion of the textile article.

Textile articles can be provided as survival items, for example, providing a ready supply of durable cord or rope for the user. Survival situations are frequently unanticipated, and providing a ready supply of easily accessible rope within an article that is casually kept or carried with the user can be advantageous to the user. For example, a key chain can include a textile token decoratively attached to the key chain. The user may carry the key chain for years, suddenly find himself or herself in a survival situation, and unravel the key chain token for use in the survival situation. Examples of the cord that can be used for survival purposes include para-chord, used in other instances to support a parachutist from a parachute, or high-test-strength climbing rope known in the art.

Textile straps created by cords or other strands are known wherein a piece of hardware is fastened to a starting edge and another piece of hardware is fastened to a finished edge of the strap. Such attachments can include, for example, pieces of leather sandwiching the textile strap between the pieces, and with sewn thread clamping the pieces and the sandwiched textile into a unit. Such attachments are inherently weak, as the textile strap tends to shift or loosen under the leather pieces and expose the clamping threads to increased wear.

A textile article is disclosed wherein a piece of hardware is threaded through loops including at least one open loop on a unfinished leading edge, such that when the piece of hardware is removed from the loops, the article is easily unraveled. Exemplary pieces of hardware can be useful, for example, including a carabiner or snap buckle, useful to attach the textile article to something else. Other pieces of hardware can be primarily used to capture the open loop or loops on the leading edge, such as an injection molded clip or a zip strap. Other pieces of hardware can be decorative, such as a plastic token with an image printed thereupon. A loose end of the textile article is tied into a stopper knot or retained with a tie down device such as a spring clip, a snapping clamp device, or a spring loaded push button clamp device.

Referring now to the drawings, wherein the showings are for the purpose of illustrating certain exemplary embodiments only and not for the purpose of limiting the same, FIG. 1 illustrates an exemplary knitted article known in the art. An exemplary knitted article 10 is illustrated. The article is unfinished, as a number of open loops 22 along leading edge 21 and a loose end 24 are illustrated. Article 10 could unravel except that knitting needles 30*a* and 30*b* are threaded through open loops 22. A series of rows 12, 14, and 16 are illustrated. Each of rows 12, 14, and 16 were at one point on a leading edge, but subsequent rows of loops were threaded through the loops of each of the rows during the stitching process of the article. Knitted and crocheted articles are well known in the art. The figures include stitching patterns internal to the various textile articles for illustration only. The stitch patterns are not intended to be taken literally, and, in all aspect not related to the novel techniques disclosed herein, the illustrated stitch patterns are not to be taken as literally representative of a knitted or crocheted article.

Figure 2:
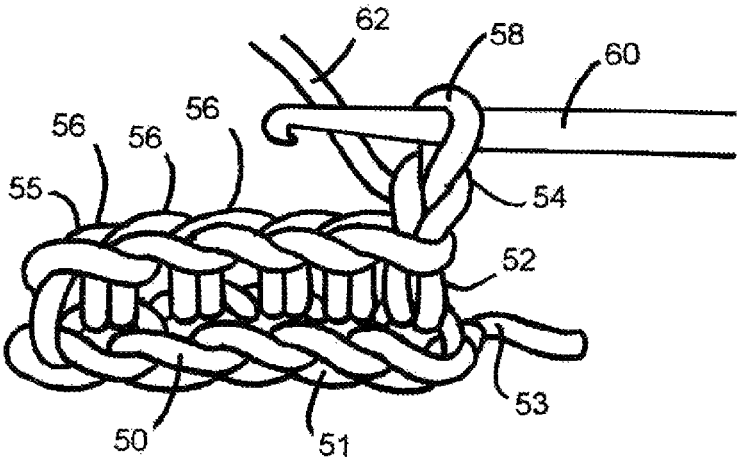
FIG.2 PRIOR ART
FIG. 2 illustrates an exemplary crocheted article that has been started, in accordance with the present disclosure.

FIG. 2 illustrates an exemplary crocheted article that has been started. An exemplary crocheted article 50 is illustrated. The article is unfinished, as a number of open 58 and a loose end 62 are illustrated. Article 50 includes secured end 53, starting edge 51, leading edge 55 including a series of closed loops 56. Row 52 is illustrated stitched upon starting edge 51. Subsequent rows can later be stitched upon leading edge 55 of row 52. Open loop 58 is illustrated threaded through a previous loop, and loose end 62 is illustrated extending from loop. Row 52 is complete, and a new row 54 is being started. Article 50 could unravel if crochet needle 60 were removed from open loop 58 and loose end 62 were pulled.

Figure 3:
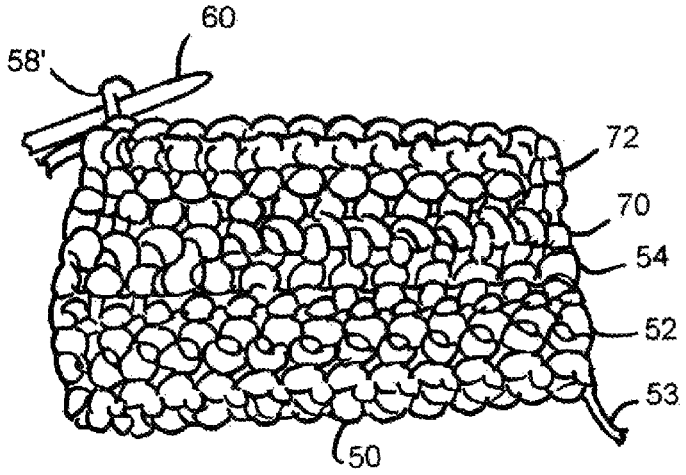
FIG.3 PRIOR ART
FIG. 3 an exemplary crocheted article in process, in accordance with the present disclosure.
Figure 4:
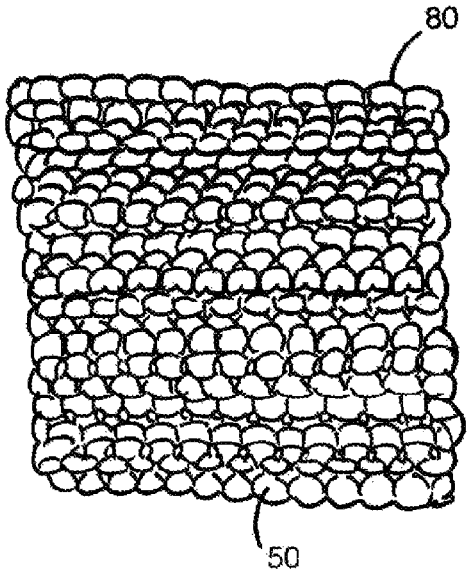
FIG.4 PRIOR ART
FIG. 4 illustrates the crocheted article of FIG. 3 in a finished state, in accordance with the present disclosure.

FIG. 3 an exemplary crocheted article in process. Unfinished crocheted article 50 is illustrated including secured end 53. Rows 52, 54, 70 and 72 are illustrated stitched according to processes known in the art. Open loop 58' is illustrated with crochet needle 60 threaded within loop 58'. FIG. 4 illustrates the crocheted article of FIG. 3 in a finished state. Additional rows were completed, the last open loop and the loose end are tied off according to processes known in the art, and finished edge 80 is complete.

Figure 5:
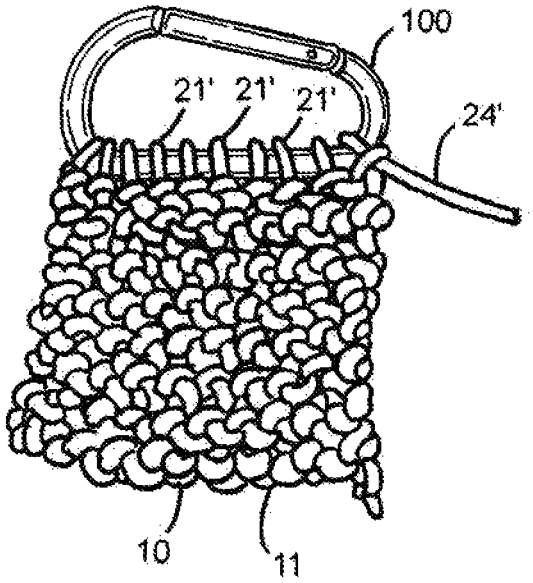
FIG. 5 illustrates an exemplary knitted article with a carabiner threaded through the open ends of the leading edge, in accordance with the present disclosure.

FIG. 5 illustrates an exemplary knitted article with a carabiner threaded through the open ends of the leading edge. Knitted article 10 is illustrated including starting edge 11. A piece of hardware exemplified by carabiner 100 is illustrated threaded through a series of open loops 21', with loose end 24' extending from the article. Loose end 24' can be temporarily or semi-permanently secured by a stopper knot or a tie down device preventing loose end 24' from unstitching a last loop 21' closest to the loose end.

Figure 6:
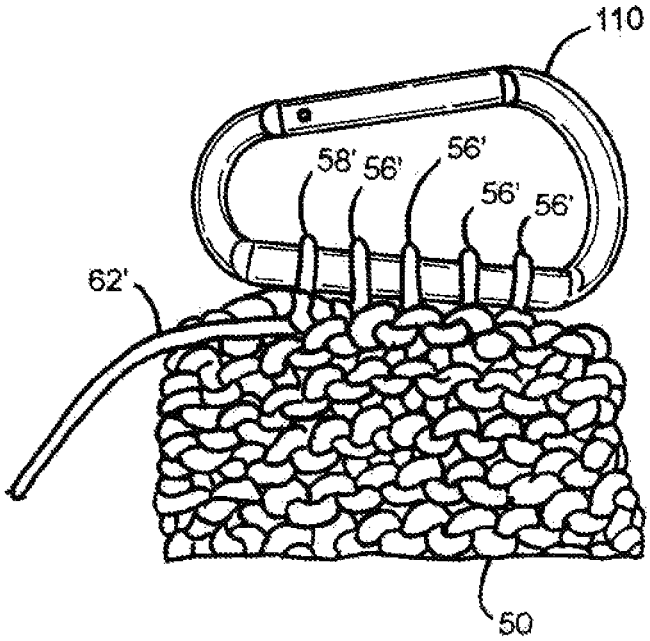
FIG. 6 illustrates an exemplary crocheted article with a carabiner threaded through the loops and the open loop of the leading edge, in accordance with the present disclosure.

FIG. 6 illustrates an exemplary crocheted article with a carabiner threaded through the loops and the open loop of the leading edge. Crocheted article 50 is illustrated. Carabiner 110 is illustrated threaded through a series of closed loops 56' and open loop 58', with loose end 62' extending from the article. Closed loops 56' usually lie flat along a leading edge. In order to make the closed loops 56' receptive to carabiner 110 or a similar piece of hardware, one must lift the closed loops 56 during or after the stitching process, thereby making the closed loops large enough to accept the carabiner. Loose end 62' can be temporarily or semi-permanently secured by a knot or a tie down device preventing loose end 62' from unstitching the open loop 58'.

Figure 7:
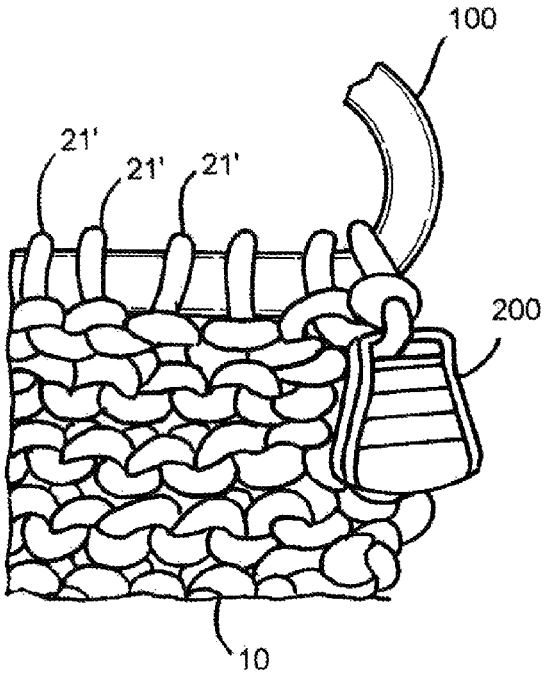
FIG. 7 illustrates the knitted article of FIG. 5, with a tie down device attached to the loose end, in accordance with the present disclosure.

FIG. 7 illustrates the knitted article of FIG. 5, with a tie down device attached to the loose end. Article 10 is illustrated. Carabiner 100 is illustrated threaded through a series of open loops 21'. A tie down device 200 is illustrated securing a loose end of article 10.

Figure 8:
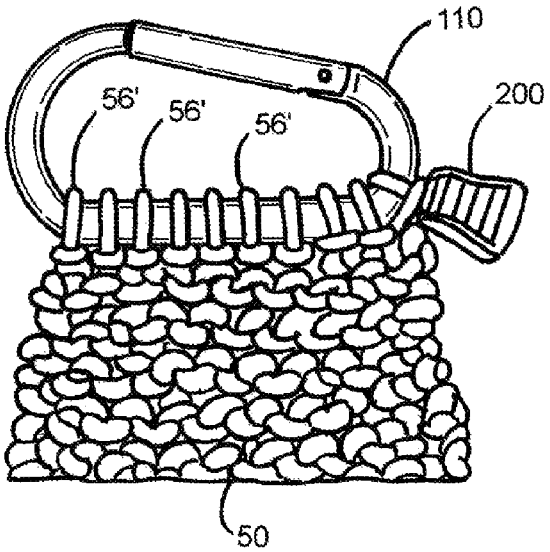
FIG. 8 illustrates an exemplary crocheted article with a carabiner threaded through the loops and the open loop of the leading edge and with a tie down device attached to the loose end, in accordance with the present disclosure.

FIG. 8 illustrates an exemplary crocheted article with a carabiner threaded through the loops and the open loop of the leading edge and with a tie down device attached to the loose end. Article 50 is illustrated. Carabiner 110 is illustrated through a series of loops 56', and tie down device 200 is illustrated securing a loose end of article 50.

Figure 9:
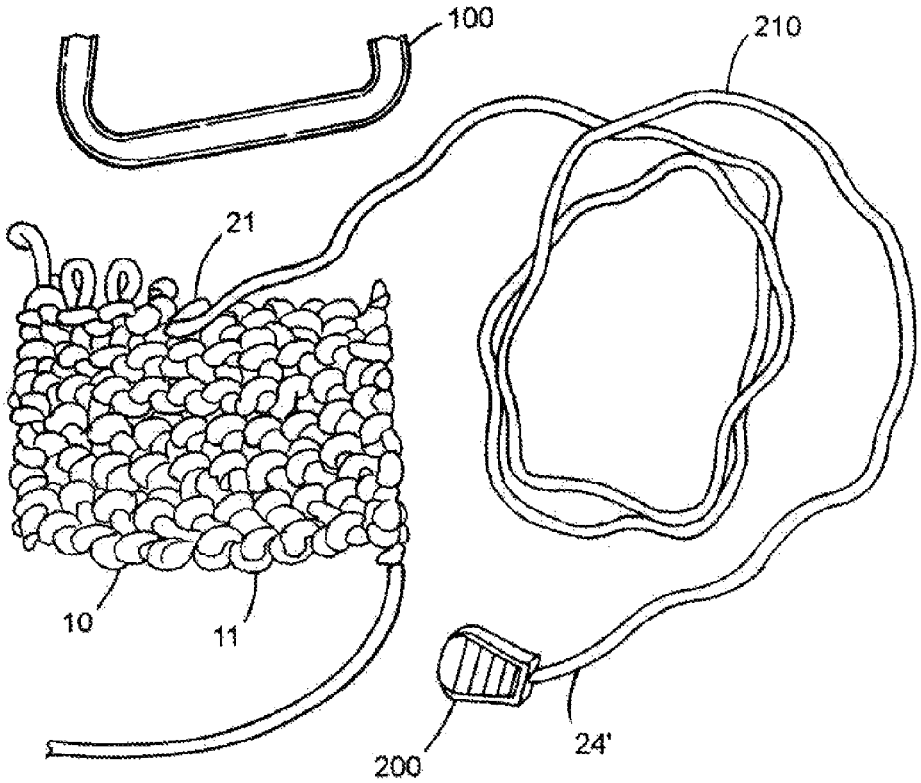
FIG. 9 illustrates the knitted article of FIG. 7, wherein the carabiner has been removed from the open loops and the loose end has been pulled, such that a length of the cord has been unraveled, in accordance with the present disclosure.

FIG. 9 illustrates the knitted article of FIG. 7, wherein the carabiner has been removed from the open loops and the loose end has been pulled, such that a length of the cord has been unraveled. Article 10 is illustrated including starting edge 11 and leading edge 21. Carabiner 100 has been removed from loops on article 10, and cord 210 including loose end 24' and tie down clamp 200 is illustrated unraveled from article 10. By continuing to pull upon cord 210, article 10 will continue to unravel.

Figure 10:
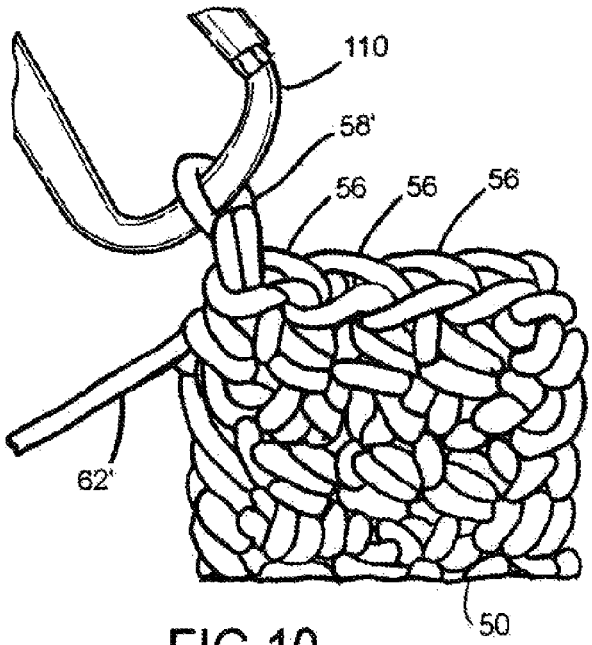
FIG. 10 illustrates an exemplary crocheted article, with a piece of hardware capturing only the open loop of the article, in accordance with the present disclosure.

FIG. 10 illustrates an exemplary crocheted article, with a piece of hardware capturing only the open loop of the article. Article 50 is illustrated including a leading edge consisting of a series of loops 56 and open loop 58'. Article 50 is attached to a carabiner 110, with the carabiner threaded through a single open loop 58'. Loose end 62' is illustrated and can be tied down according to processes disclosed herein.

Figure 11:
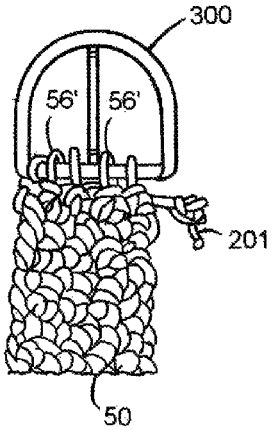
FIG. 11 illustrates an exemplary knitted belt, with the loose end tied in a stopper knot, in accordance with the present disclosure.
Figure 12:
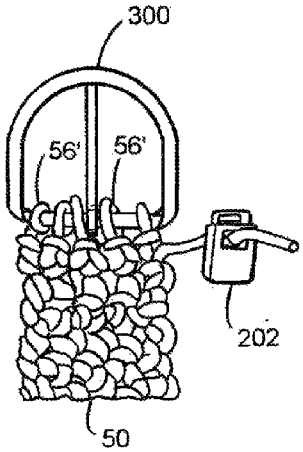
FIG. 12 illustrates an exemplary knitted belt, with the loose end captured by a push button release device, in accordance with the present disclosure.
Figure 13:
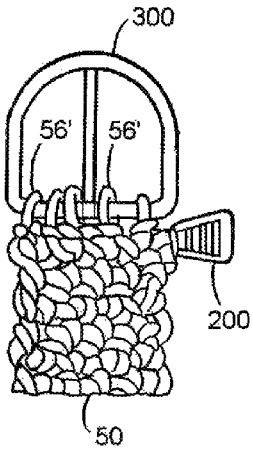
FIG. 13 illustrates an exemplary knitted belt, with the loose end captured by a snap shut device, in accordance with the present disclosure.

FIG. 11 illustrates an exemplary knitted belt, with the loose end tied in a stopper knot. Article 50 is illustrated including a belt strap. Belt buckle 300 is attached to article 50 through a series of loops including loops 56' according to processes disclosed herein. A loose end has been tied into knot 201. FIG. 12 illustrates an exemplary knitted belt, with the loose end captured by a push button release device. Article 50 is illustrated including a belt strap. Belt buckle 300 is attached to article 50 through a series of loops including loops 56' according to processes disclosed herein. A loose end has been secured by a tie down device 202 embodied as a plastic unit including an internal spring biasing the device to a gripping state, wherein depression of a button permits device 202 to release the loose end. FIG. 13 illustrates an exemplary knitted belt, with the loose end captured by a snap shut device. Article 50 is illustrated including a belt strap. Belt buckle 300 is attached to article 50 through a series of loops including loops 56' according to processes disclosed herein. A loose end has been secured by a tie down device 200 embodied as a snapping device is positioned initially secure and selectably release the loose end. Snapping devices can include any known devices wherein a detent or other gripping feature permits portions of the device to temporarily be clamped upon the loose end.

Figure 14:
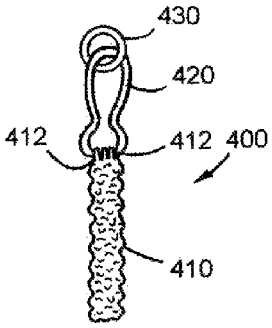
FIG. 14 illustrates an exemplary textile keychain capable of being easily unraveled, in accordance with the present disclosure.

FIG. 14 illustrates an exemplary textile keychain capable of being easily unraveled. Key chain 400 including textile article 410 is illustrated, article 410 stitched according to processes disclosed herein. Loops 412 are illustrated securing key chain hardware 420 to article 410, wherein at least one of loops 412 is an open loop that would cause article 410 to easily unravel if not secured by a piece of hardware such as key chain hardware 420. Key loop 430 is illustrated installed to hardware 420.

Figure 15:
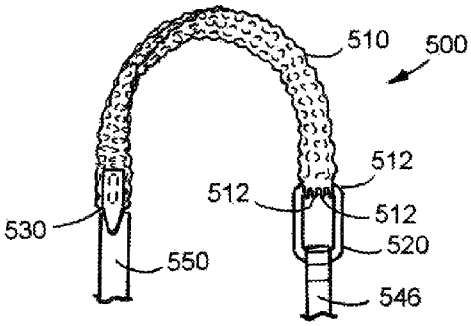
FIG. 15 illustrates an exemplary textile rifle sling capable of being easily unraveled, in accordance with the present disclosure.

FIG. 15 illustrates an exemplary textile rifle sling capable of being easily unraveled. Rifle sling 500 including textile article 510 is illustrated, article 510 stitched according to processes disclosed herein. Loops 512 of a leading edge of article 510 are illustrated securing a piece of hardware embodied as ring 520. Ring 520 is attached to an adjacent strap 546. A starting edge of article 510 can be attached to according to a number of methods. A pair of leather pieces 530 are illustrated sewn to article 510. Adjacent strap 550 is illustrated connected to pieces 530.

Figure 16:
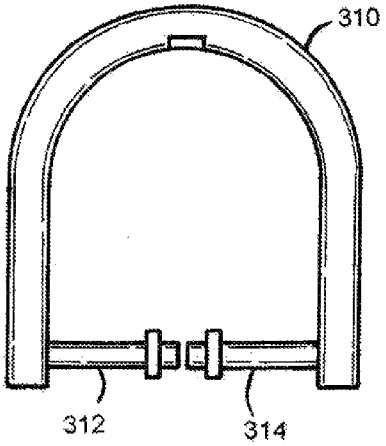
FIG. 16 illustrates an exemplary belt buckle capable of quickly releasing loops of a textile article, in accordance with the present disclosure.

FIG. 16 illustrates an exemplary belt buckle capable of quickly releasing loops of a textile article. Belt buckle 310 is illustrated including separable features 312 and 314. Buckle 310 in a normal state can retain a belt buckle clasp, and features 312 and 314 can be attached to a textile article by threading the features through loops on the article. Buckle 310 can be flexed, separating features 312 and 314 such that loops can either be attached or disengaged from the features.

Figure 17:
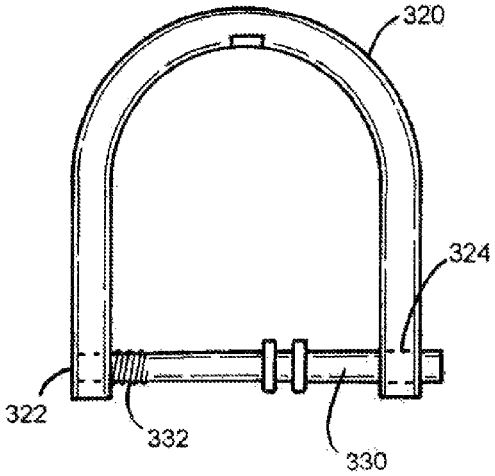
FIG. 17 illustrates another exemplary belt buckle capable of quickly releasing loops of a textile article, in accordance with the present disclosure.

FIG. 17 illustrates another exemplary belt buckle capable of quickly releasing loops of a textile article. Belt buckle 320 is illustrated including through holes 322 and 324. Hole 324 is smooth, while hole 322 is threaded. Post 330 includes features to retain a belt buckle clasp and a threaded end 332. End 332 can be screwed into hole 322 to secure the post. End 332 can be unscrewed from hole 322 such that loops can either be attached or disengaged from post 330.

Figure 18:
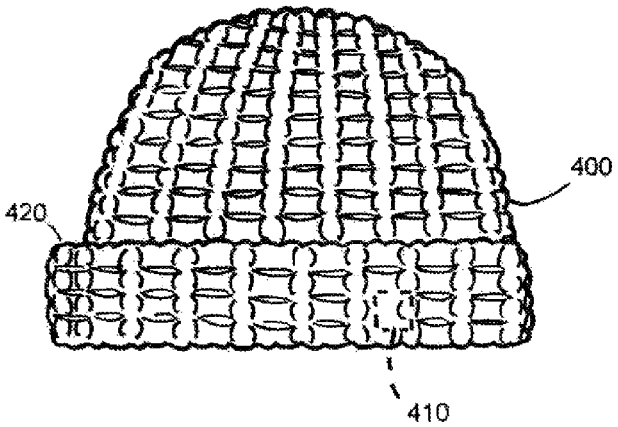
FIG. 18 illustrates an exemplary textile stocking cap capable of being easily unraveled, in accordance with the present disclosure.

Textile articles can include articles of clothing. FIG. 18 illustrates an exemplary textile stocking cap capable of being easily unraveled. Stocking cap 400 is illustrated. Cap 400 can be knitted or crocheted according to disclosed methods. A leading edge can end up at either an apex of cap 400 or along the folded up brim of cap 400. The leading edge, in either location, includes hardware threaded through at least one open loop and a loose end is tied down. Hidden device 410 is illustrated, for example, as a small device threaded through an open loop of a crocheted cap, and the device is tucked under the folded up brim. In another embodiment, a knitted cap can include an elastic band serving as hardware threaded through open loops along edge 420. Such an elastic band could match in color the color of the rest of the cap. In another embodiment, the elastic band could be a contrasting color to the rest of the cap, reminding the user that the cap can be easily unraveled, if desired.

Figure 19:
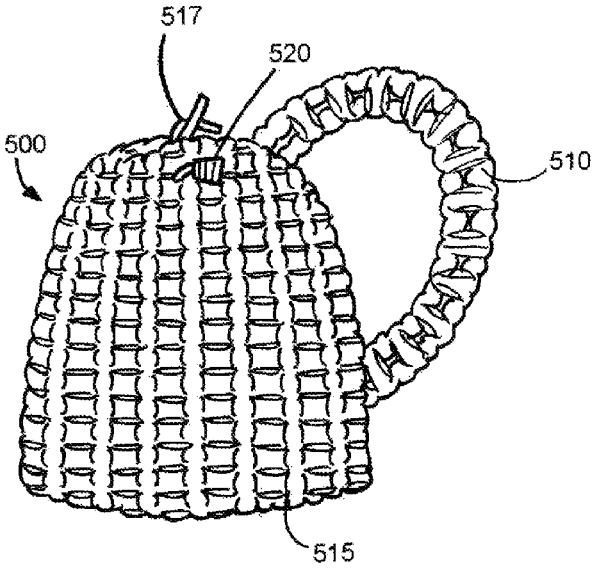
FIG. 19 illustrates an exemplary textile backpack capable of being easily unraveled, in accordance with the present disclosure.

FIG. 19 illustrates an exemplary textile backpack capable of being easily unraveled. Backpack 500 is illustrated including pack body 515 and strap 510. Wherein backpack 500 is a knitted textile, the series of open loops of the leading edge can be an opening at the top of body 515, and a cinching strap 517 can used as the hardware threaded through the open loops. By pulling the strap 517 tight, the hole of the backpack 500 can be closed. A loose end for backpack 500 is secured by tie down device 520. In the event that the user needs the cord used to construct the backpack 500, the cinching strap 517 can be removed, and the loose end 520 can be pulled to unravel the backpack. In one embodiment, a portion of the backpack can be constructed of a finished textile, and another portion of the backpack can be constructed of an unfinished textile according to the processes disclosed herein, such that unraveling the unfinished portion of the backpack does not make the backpack unusable. In one embodiment, one strap of the backpack can be unraveled, while the other strap remains intact.

Figure 20:
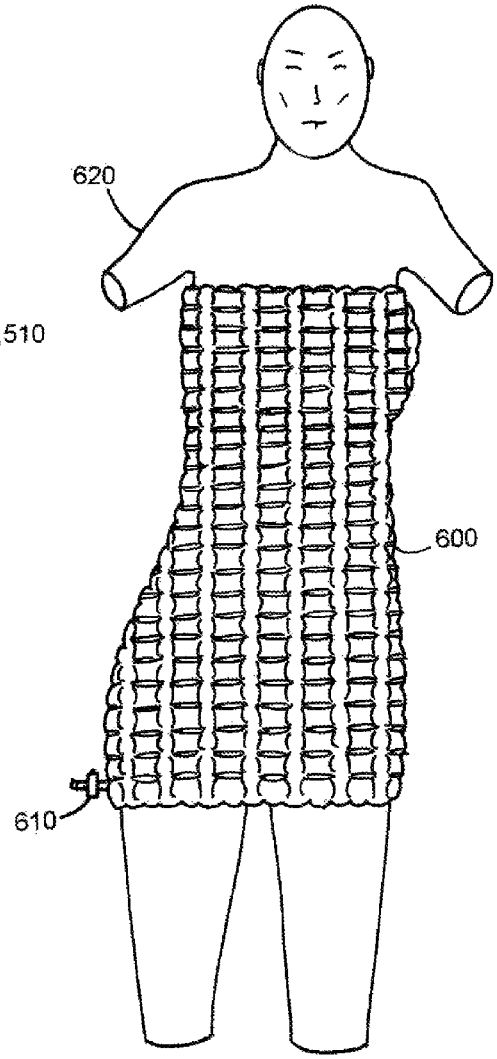
FIG. 20 illustrates an exemplary textile dress capable of being easily unraveled, in accordance with the present disclosure.

FIG. 20 illustrates an exemplary textile dress capable of being easily unraveled. Dress 600 is illustrated upon mannequin 620. Dress 600 includes an exemplary tie down device 610. Hardware threaded through an open loop or open loops can be a cord or band made to blend in with the pattern of the dress. In another embodiment, the hardware can be made of a color to stand out as a fun or marketable way to draw attention to the ability of the dress to be unraveled.

Figure 21:
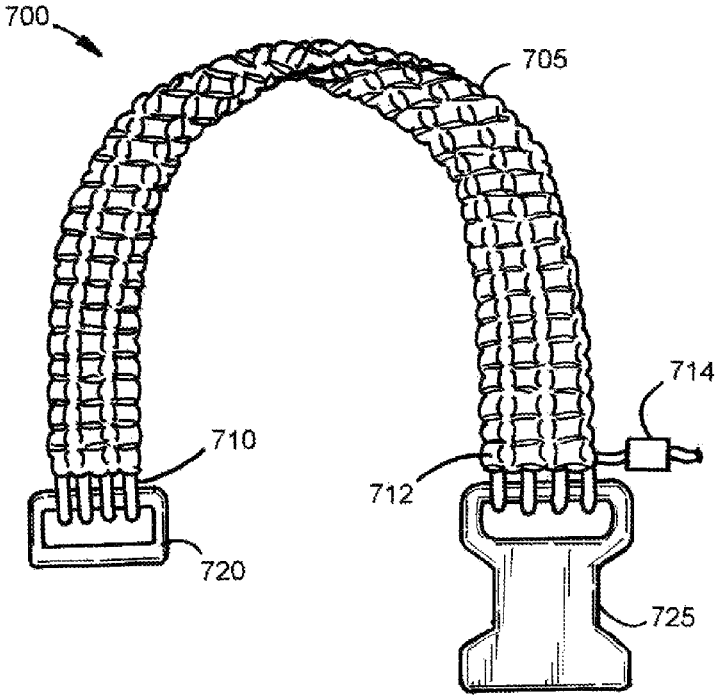
FIG. 21 illustrates an exemplary textile strap capable of being easily unraveled, with a starting edge including loops around a piece of hardware, in accordance with the present disclosure.

FIG. 21 illustrates an exemplary textile strap capable of being easily unraveled, with a starting edge including loops around a piece of hardware. Strap 700 includes textile article 705. Starting edge 710 includes a series of loops attached to loop 720. Leading edge 712 includes a series of loops attached to snap buckle 725 according to processes disclosed herein. Tie down device 714 is illustrated connected to a loose end of article 705.

Figure 22:
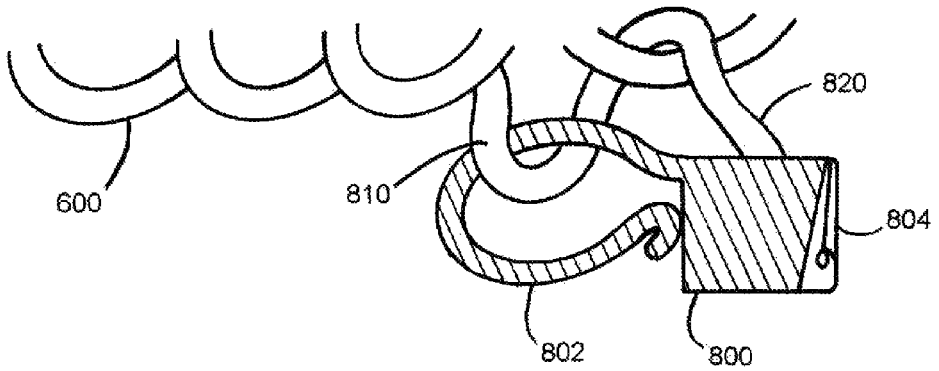
FIG. 22 illustrates an exemplary tie down device that includes a loop to capture an open loop, in accordance with the present disclosure.

FIG. 22 illustrates an exemplary tie down device that includes a loop to capture an open loop. Tie down device 800 is illustrated including a loop 802 to be threaded through an open loop 810 of dress 600 and a clamp 804 securing loose end 820 of dress 600. A single device can both serve as the hardware to be threaded through an open loop or open loops and as the tie down device. In another embodiment, a plurality of pieces of hardware could be threaded through loops on single leading edge of a textile article. In one embodiment, more than one piece of hardware could be threaded through a single loop. In one embodiment, a redundant piece of hardware such as a secured zip strap known in the art could be added as a safety device in addition to another piece of hardware, preventing unintentional release and unraveling of the textile article.

Figure 23:
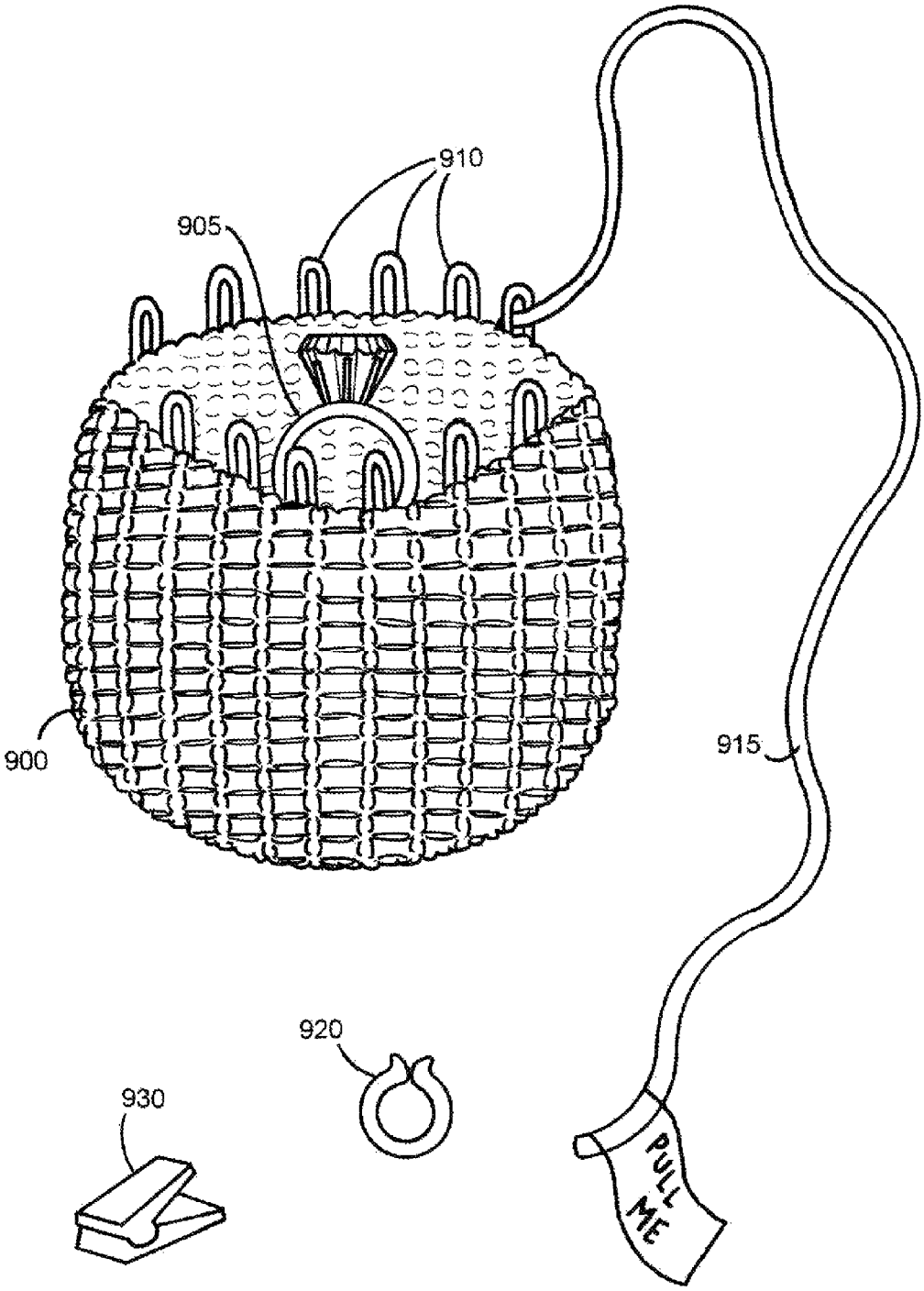
FIG. 23 illustrates an exemplary novelty gift wrapper capable of being easily unraveled, in accordance with the present disclosure.

FIG. 23 illustrates an exemplary an exemplary novelty gift wrapper capable of being easily unraveled. Wrapper 900 is illustrated as a textile article stitched and created according to the processes disclosed herein. The wrapper 900 is illustrated in a partially unraveled state, with an exemplary engagement ring 905 contained within. Open loops 910 are illustrated and cord 915 is shown pulled away from wrapper 900. Hardware loop 920 and tie down device 930 are shown removed from wrapper 900. The ring 905 could be placed within the article as it is being stitched and prior to hardware being threaded through open loops. In another embodiment, the string or yarn used to create the article can be stretchy enough that the ring can be inserted within the textile after the hardware is installed and the loose end is secured.

A process for creating a device including a crocheted textile article is disclosed to include: creating a starting edge of the crocheted textile article, creating a leading edge of the crocheted textile article, lifting a series of closed loops on the leading edge, threading a piece of hardware through the lifted closed loops and an open loop of the crocheted textile article, and securing a loose end of the crocheted textile article.

The disclosure has described certain preferred embodiments and modifications of those embodiments. Further modifications and alterations may occur to others upon reading and understanding the specification. Therefore, it is intended that the disclosure not be limited to the particular embodiment(s) disclosed as the best mode contemplated for carrying out this disclosure, but that the disclosure will include all embodiments falling within the scope of the appended claims.

The invention claimed is:

1. A multifunctional device comprising:

a crocheted or knitted textile article;

a hardware device, wherein a portion of the hardware device is threaded through an open loop at a leading edge of the textile article; and a stopper knot or a tie down device secured to a loose end of the textile device, wherein the stopper knot or the tie down device cooperates with the hardware device to finish the textile article such that the textile article is usable for a first purpose without unraveling by preventing the loose end of the textile article from unstitching the open loop, and wherein the textile article is configured to unravel, for a second purpose, by removing the portion of the hardware device from the open loop and pulling on the loose end.

2. The device of claim 1, wherein the stopper knot or the tie down device is configured so as to be unable to unstitch a loop of the textile article.

3. The device of claim 1, wherein the stopper knot or the tie down device is configured so as to be unable to unstitch a loop of the textile article while the portion of the hardware device is threaded through the open loop.

4. The device of claim 1, wherein the leading edge comprises a plurality of open loops, and wherein the hardware device is further threaded through the plurality of open loops.

5. The device of claim 1, wherein the hardware device comprises one of a carabiner, a loop, a buckle, an injection molded clip, a snap connection device, or a tie strap.

6. The device of claim 1, wherein the tie down device comprises one of a push button release or a snapping device.

7. The device of claim 1, wherein the hardware device is a belt buckle, and wherein the first purpose is using the device as a belt.

8. A multifunctional device, comprising:

a crocheted textile article; and a hardware device, wherein a portion of the hardware device is threaded through a plurality of loops at a leading edge of the textile article, wherein one of the loops is open; and wherein the portion of the hardware device threaded through the plurality of loops of the crocheted textile article finishes the crocheted textile article such that the crocheted textile article is usable for a first purpose without unraveling, and wherein the crocheted textile article is configured to unravel, for a second purpose, by removing the portion of the hardware device from the plurality of loops and pulling upon a loose end of the textile article.

9. The device of claim 8, wherein the hardware device comprises one of a carabiner, a loop, a buckle, an injection molded clip, a snap connection device, or a tie strap.

10. The device of claim 8, further comprising a stopper knot or a tie down device secured to a loose end of the textile article.

11. The device of claim 10, wherein the stopper knot or the tie down device cooperates with the hardware device to finish the textile article.

12. The device of claim 10, wherein the stopper knot or the tie down device prevents the loose end from unstitching the open loop.

13. The device of claim 10, wherein the stopper knot or the tie down device is configured so as to be unable to unstitch a loop of the textile article.

14. The device of claim 11, wherein the stopper knot or the tie down device is configured so as to be unable to unstitch a loop of the textile article while the portion of the hardware device is threaded through the open loops.

15. The device of claim 10, wherein the tie down device comprises one of a push button release or a snapping device.

16. A method for adjusting a multifunctional textile device from a first state to a second state, the method comprising:

obtaining the multifunctional textile device in a first, finished state, the multifunctional textile device comprising:

a crocheted or knitted textile article, a hardware device, wherein a portion of the hardware device is threaded through an open loop at a leading edge of the textile article, and a stopper knot or a tie down device secured to a loose end of the textile device, wherein the stopper knot or the tie down device cooperates with the hardware device to retain the textile article in the first, finished state without unraveling by preventing the loose end of the textile article from unstitching the open loop;

removing the portion of the hardware device from the open loop at the leading edge of the textile article; and pulling on the loose end of the textile article, thereby, unraveling the textile article into a second, unraveled state.

17. The device of claim 16, wherein the leading edge comprises a plurality of open loops, wherein in, the first, finished state, the hardware device is threaded through the plurality of open loops, and wherein removing the portion of the hardware device from the open loop at the leading edge of the textile article comprises removing the portion of the hardware device from the plurality of open loops at the leading edge of the textile article.

18. The device of claim 16, wherein the hardware device comprises one of a carabiner, a loop, a buckle, an injection molded clip, a snap connection device, or a tie strap, and wherein the tie down device comprises one of a push button release or a snapping device.

* * * * *